United States Patent [19]

Agnew

[11] 4,418,790

[45] Dec. 6, 1983

[54] METHOD AND APPARATUS FOR ATTENUATING SOUND

[75] Inventor: Ralph E. Agnew, Gardena, Calif.

[73] Assignee: McCulloch Corporation, Los Angeles, Calif.

[21] Appl. No.: 322,561

[22] Filed: Nov. 18, 1981

[51] Int. Cl.[3] ..... F01N 1/08

[52] U.S. Cl. ..... 181/268; 181/239; 181/275; 181/282; 181/296

[58] Field of Search ..... 181/206, 231, 239, 240, 181/265, 268, 269, 272, 274, 275, 282, 403

[56] References Cited

U.S. PATENT DOCUMENTS

| | | | |
|---|---|---|---|
| 1,866,004 | 7/1932 | Beamer | 181/265 |
| 3,177,973 | 4/1965 | Benez | 181/274 |
| 3,704,763 | 12/1972 | Becker et al. | 181/268 |
| 3,750,841 | 8/1973 | Brown | 181/224 |
| 3,948,349 | 4/1976 | Bychinsky | 181/206 |
| 3,968,854 | 7/1976 | Gordon et al. | 181/269 |
| 4,165,798 | 8/1979 | Martinez | 181/268 |

*Primary Examiner*—Benjamin R. Fuller

*Attorney, Agent, or Firm*—Murray & Whisenhunt

[57] ABSTRACT

Methods and apparatus for attenuating sound levels characterized by a muffler utilizing the splitting of exhaust gas flows followed by recombining of these split flows in mutually opposed relationship. Sequentially alternating expansion and contraction of the exhaust gas is caused to occur, during which increments of exhaust gas exit sequentially along the exhaust gas flow from the muffler.

10 Claims, 8 Drawing Figures

METHOD AND APPARATUS FOR ATTENUATING SOUND

GENERAL BACKGROUND AND SUMMARY OF INVENTION

Increasingly stringent environmental protection considerations have led to intensified efforts to reduce the sound level associated with devices such as small engine operated chain saws, vehicles, and tools of various nature.

In this connection, prior practioners in the muffler art have employed the technique of splitting an exhaust flow, with the split flow being subsequently merged, as evidenced by the disclosure of Martinez U.S. Pat. No. 4,165,798 (Aug. 28, 1979).

Other techniques for utilizing split flow arrangements in muffler structures are disclosed in patents such as:

Benez—U.S. Pat. No 3,177,973 (Apr. 13, 1965)
Becker et al.—U.S. Pat. No. 3,704,763 (Dec. 5, 1971)
Brown—U.S. Pat. No. 3,750,841 (Aug. 7, 1971)
Bychinsky—U.S. Pat. No. 3,948,349 (Apr. 6, 1976)
Gordon et al.—U.S. Pat. No. 3,968,854 (July 13, 1976)

It has also been recognized, for example in above noted Gordon et al. U.S. Pat. No. 3,968,854, that sound attenuating benefits may be derived by causing a previously split and recombined exhaust gas flow to pass through a turbulence generating zone.

The present invention departs from the prior art in contemplating combination concepts which uniquely integrate exhaust gas flow splitting and recombining with alternate compression and expansion which takes place while permitting increments of the exhaust gas flow to exit sequentially from a muffler. These combination concepts, hereinafter discussed, are significant in both a method and apparatus sense.

These individually significant aspects of the invention will now be described with respect to the method context of the invention, it being understood that each individual significant method aspect is associated with a counterpart apparatus aspect, also of independent significance.

A first method aspect of the invention resides in a method for attenuating sound levels of exhaust gas issuing from engine exhaust systems, which method comprises:

transmitting a flow of engine exhaust gas into muffler means;

splitting the exhaust gas flow into first and second, flow paths within the muffler means;

recombining exhaust gas from each of the first and second flow path within the muffler means by flowing gas from each of the first and second flow paths generally toward and into each other as mutually opposed gas flows to form a unified exhaust gas flow; and alternately compressing and expanding the exhaust gas flow while concurrently permitting increments of the exhaust gas flow to exit from the muffler means, sequentially along the flow of the exhaust gas flow.

In a second, independently significant method aspect of the invention, the first method aspect is supplemented by the progressive constricting of exhaust gas flow in each of the first and second flow paths, with the exhaust gas in each of the first and second flow paths, during this progressive constricting, passing in heat dissapating relationship with heat transmitting external wall means of the muffler means. The recombining of exhaust gas flow from each of the first and second flow paths is effected with an abrupt constriction of the unified exhaust gas flow and the concurrent causing of the unified exhaust gas flow to abruptly undergo a transversely directed change in flow direction. Alternately opposite, transverse changes in flow direction are caused to occur in the exhaust gas flow concurrently with the alternate compressing and expansion of exhaust gas flow.

A third independently significant method aspect of the invention entails, following the recombining of exhaust gas flow from each of the first and second flow paths, the resplitting of the unified exhaust gas flow into third and fourth flow paths of generally equal length, with the first and second flow paths also being of generally equal length. Exhaust gas flow from each of these third and fourth flow paths is recombined by flowing gas from each of the third and fourth flow paths toward and into each other as generally mutually opposed gas flows to form a reunified exhaust gas flow.

A fourth independently significant method aspect of the invention entails a refinement of the third method aspect wherein gas flowing through each of the first, second, third and fourth flow paths is progressively constricted and caused to pass in heat dissapating relation with heat transmitting external wall means of the muffler means. In addition, unified exhaust gas flow obtained by recombining exhaust gas from each of the first and second flow paths is abruptly constricted and caused to abruptly undergo a transversely directed change in flow direction.

A fifth independently significant method aspect of the invention entails a refinement of the fourth method aspect wherein exhaust gas flow is caused to expand after the recombining of exhaust gas flowing from the first and second flow paths. In addition, exhaust gas is caused to undergo generally opposite, transverse changes in flow direction in conjunction with the alternate compressing and expansion of the reunified exhaust gas flow.

Having generally described the various independently significant aspects of the invention, a detailed description of a presently preferred form of the invention will be presented with respect to the appended drawings.

DRAWINGS

By way of illustrating the presently preferred muffler embodiment of the invention presented herein, but without intending to limit the invention with respect to its scope or variety, a muffler structure will now be described which is illustrated in the attached drawings in FIGS. 1–8.

In describing the various views of the muffler shown in FIGS. 1–8, for purposes of convenience and illustration, reference will be made to the orientation of the muffler as shown. However, it will be understood that the orientation of the muffler may vary in accordance with the engine structure with which it is associated and the orientation of the overall combination of the engine and muffler during use.

FIG. 1 provides a side elevational view of the preferred embodiment muffler of the present invention;

FIG. 2 provides a side elevational view of the FIG. 1 embodiment, viewing FIG. 1 from the left;

FIG. 3 provides a side elevational view of the FIG. 1 muffler, viewing FIG. 1 from the right;

FIG. 4 provides an "exploded" view of the FIG. 1 muffler, illustrating the muffler housing and the muffler components contained therein;

FIGS. 5–8 provide sectional views, in enlarged format, of the FIG. 1 muffler;

FIG. 5 provides such a sectional view as viewed along section line 5—5 of FIG. 7;

FIG. 6 provides a sectional view of the muffler of the present invention as generally viewed along section line 6—6 of FIG. 7;

FIG. 7 provides a transverse sectional view of the FIG. 1 muffler, as viewed generally along section line 7—7 depicted in each of FIGS. 3 and 6; and FIG. 8 provides a traansverse sectional view of the FIG. 1 muffler as generally viewed along section line 8—8 depicted in each of FIGS. 3 and 6.

Having generally described the subject matter of the illustrations of the appended drawings, a detailed description of the preferred embodiment will now be undertaken.

DESCRIPTION OF PREFERRED EMBODIMENT

In describing the embodiment of the muffler 1 featured in FIGS. 1–8, the general nature of the components shown in FIG. 4 will first be described, after which the assembly of the components will be discussed.

The final phase of the detailed description of the preferred embodiment will involve a description of the functional aspects of the muffler.

Muffler Components

Figure 2:
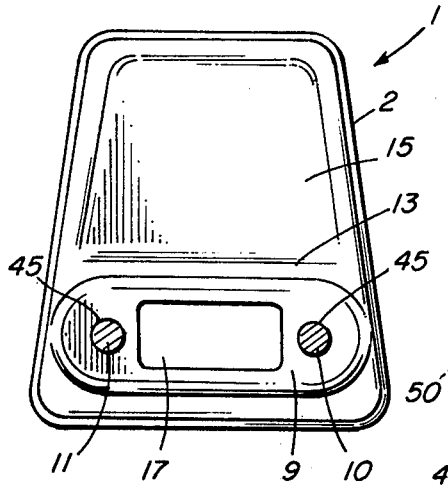
Figure 1:
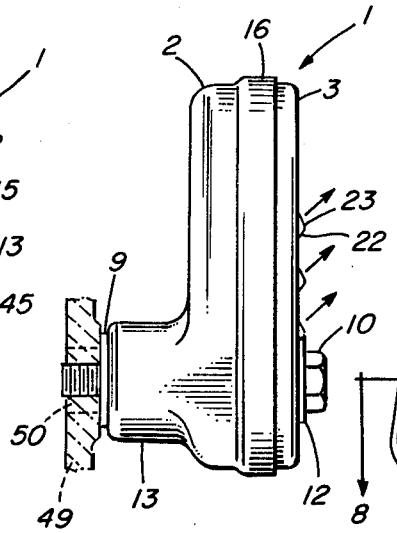
Figure 3:
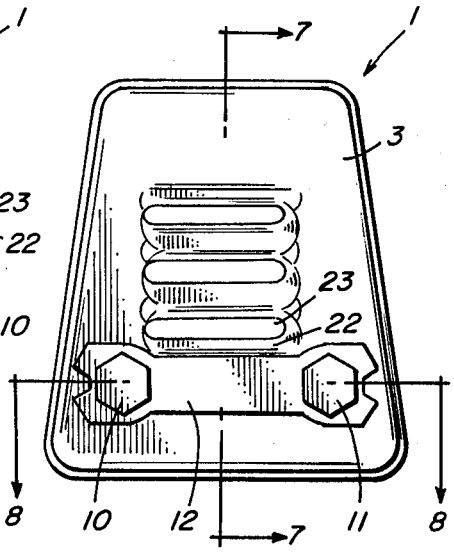
Figure 4:
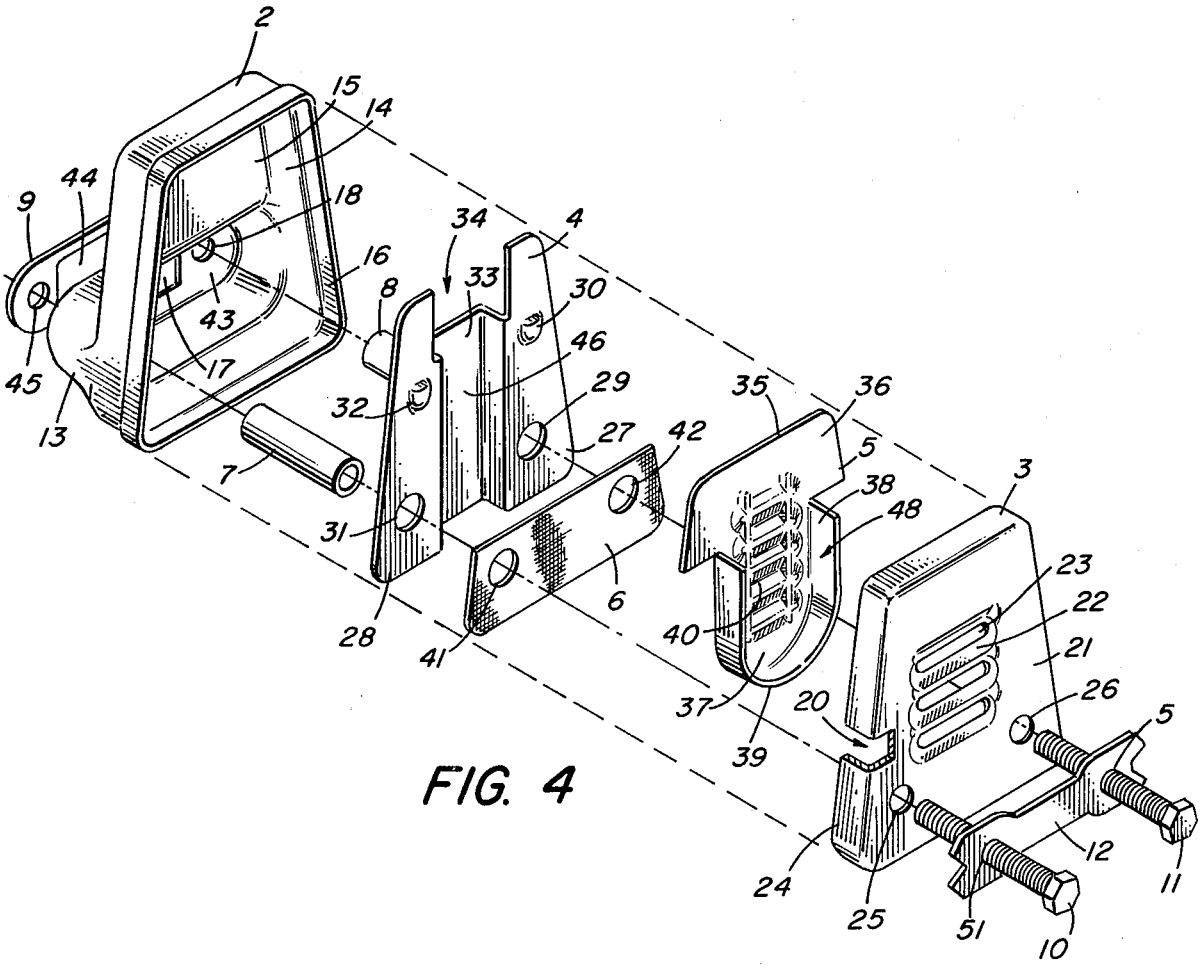

The components of muffler 1, as shown in their "exploded-view" format of FIG. 4, comprise a first housing shell 2, a second housing shell 3 telescopingly mateable with shell 2, a first baffle 4, a second baffle 5, a spark screen 6, sleeves 7 and 8, a reinforcing or mounting plate 9, threaded fasteners 10 and 11, and a washer-plate 12.

First housing shell 2 has a generally L shaped configuration, as viewed from the side, which is defined by a tube-like exhaust receiving portion 13 and a tapered cavity defining portion 14. Cavity 14 includes a rear wall 15 which merges at generally right angles with the top of the exhaust entry portion 13. Tapered cavity 14 also includes a rim like periphery 16 which provides a telescoping connection with shell 3.

First housing shell 2 also includes an exhaust entry port 17 and threaded fastener receiving holes 18 and 19.

The second housing shell 3 also defines a tapered cavity 20 and includes an outer wall 21. This wall 21 contains inclined louvers 22 alternating with inclined exhaust outlets 23 which are alternately positioned along the longitudinal axis of the housing 3 (i.e. the upright axis as shown in FIG. 4). The oppositely inclined orientation of the openings 23 and the louvers 22 is depicted in FIGS. 4 and 7.

Figure 7:
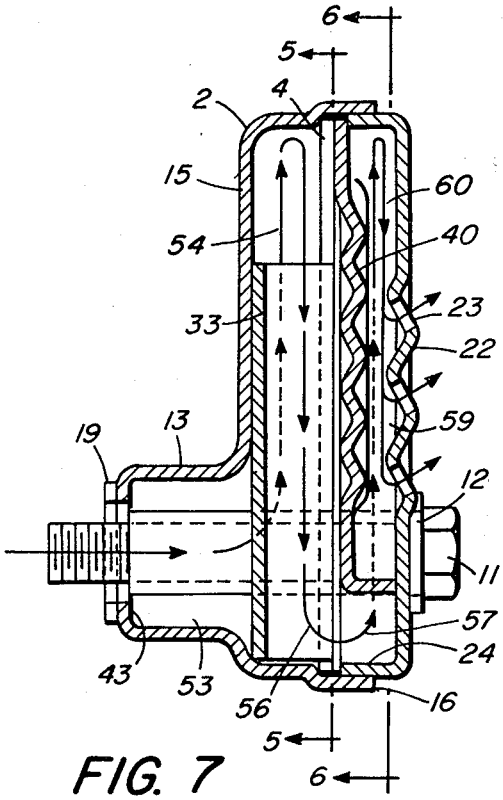
Figure 8:
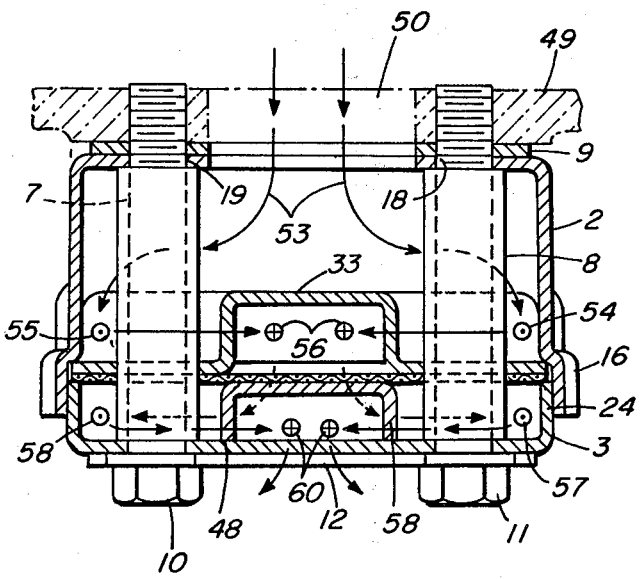

Housing shell 3 also includes an encircling rim 24 which is telescopingly received within the rim 16 of the first housing shell 2 and abuttingly engages the screen 6 and baffle 5 as generally shown in FIG. 7.

Housing shell 3 further includes threaded member receiving openings 25 and 26.

First baffle 4 includes tapered, plate like wall means 27 and 28. Wall means 27 includes a threaded fastener receiving opening 29 and a dimple or ledge-like abutment 30 which serves to support the second baffle 5 as hereinafter described. Similarly, tapered wall 28 includes a threaded fastener receiving opening 31 and another dimple or ledge-like support 32 for baffle 5.

A connecting plate 33, having a generally U-shaped cross section, interconnects tapered plate members 27 and 28 as shown in FIG. 4. U-shaped connecting compartment 33 (i.e. a connecting web or channel-like wall) terminates short of the upper ends of tapered plates 27 and 28 as shown in FIG. 4 so as to define an opening port 34.

The second baffle 5 comprises a base plate 35 having a generally T-shaped plan view configuration. This baffle provides a transversely extending head wall portion 36 and a longitudinally extending leg portion 37. Leg portion 37 is bounded by a U-shaped rim means 38. Extending longitudinally of base plate 35, in a generally upright direction when viewing the apparatus as shown in FIG. 4, is a generally corrugated or "wash board" baffle surface 40.

Spark screen 6 is of a generally tapered configuration, in a plan view sense, and is operable to generally snuggly and telescopingly fit within the rim 16, against the plate portions 27 and 28 of first baffle 4.

Spark screen 6 is provided with threaded fastener receiving openings 41 and 42.

Tubular spacers 7 and 8 define passageways for the threaded fasteners 10 and 11. Tubular member 7 is operable to telescopingly project through openings 31 and 41 of components 3 and 6 respectively and be aligned with openings 19 and 25. Similarly, tubular spacer 8 is operable to pass telescopingly through openings 29 and 42 of components 4 and 6 respectively and be aligned with shell openings 18 and 26.

Reinforcing or mounting plate 9 is provided with an exhaust receiving port 44 which may have a rectangular configuration, like that of opening 17 of housing shell 2. Mounting plate 9 is provided with threaded fastener receiving openings 45, aligned respectively with openings 18 and 19 of housing shell 2, and operable to receive the threaded fasteners 10 and 11.

The muffler components heretofore described are generally telescopingly assembled into the configuration shown in FIG. 7.

In this assembled configuration, the plate 9 is abuttingly secured to or mounted against the rear wall 43 of housing 2. First baffle 4 is disposed with the tapered wall means 27 and 28, flushly engaging the rear wall means 15 of the shell 2. The lower, wider tapered portions of the wall means 27 and 28, which project below the rear wall 15, are spaced from the wall 43 of housing shell 2, as generally shown in FIG. 7. Spark screen 6 flushly engages the right side of tapered walls 27 and 28, when the apparatus is viewed as shown in FIGS. 4 and 7, with the mid portion of screen 6 being spaced from the left most wall or base wall 46 of U-shaped connecting component 33 of first baffle 14.

The head wall 36 of baffle 5 flushly engages the upper portions of tapered walls 27 and 28, with the lower laterally projecting edges of head wall 36 resting on the abuttments or support ledges 30 and 32. This supporting arrangement, as shown in FIG. 7, supports the second baffle 5 on the first baffle 4, with the rim 38 being spaced above the lower edge of the screen 6 so as to define a screened outlet port 47 at the lower end of the central cavity 48, defined by U-shaped connecting component 33.

Second housing shell 3 is telescopingly assembled with the components assembled as noted above, with rim 24 telescopingly receiving rim 16 of the first housing shell 2. When so positioned, the shell 3 is positioned such that the U-shaped rim 38 encircles the sides and lower edge of the louvered outlet assembly 22/23, with the edge 39 of rim 38 abuttingly engaging the wall means 21 along the sides and lower portion of the louver/opening arrangement 22/23.

The components thus assembled are secured by the insertion of the threaded fasteners 10 and 11 through the assembly, into threaded engagement with an engine wall portion 49. Thus, the threaded fasteners 10 and 11 pass through the spaced shells 2 and 3, the tubular members 7 and 8, the housing shell openings 18 and 19, and the reinforcing or mounting plate openings 45 and engage the to engine wall means 49 encircling an engine exhaust outlet 50, as shown generally in FIG. 1. Threaded fasteners 10 and 11 also pass through openings 51 and 52 of washer plate 12 which engages the outer surface of wall 21 of housing shell 3.

Figure 5:
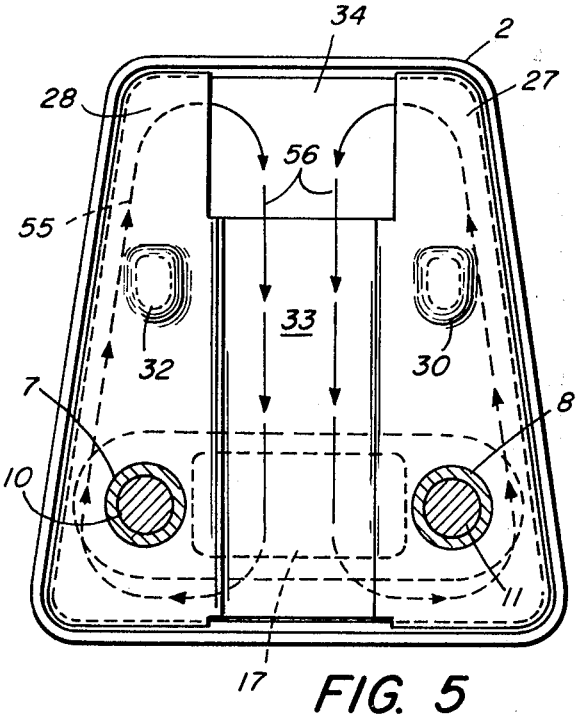
Figure 6:
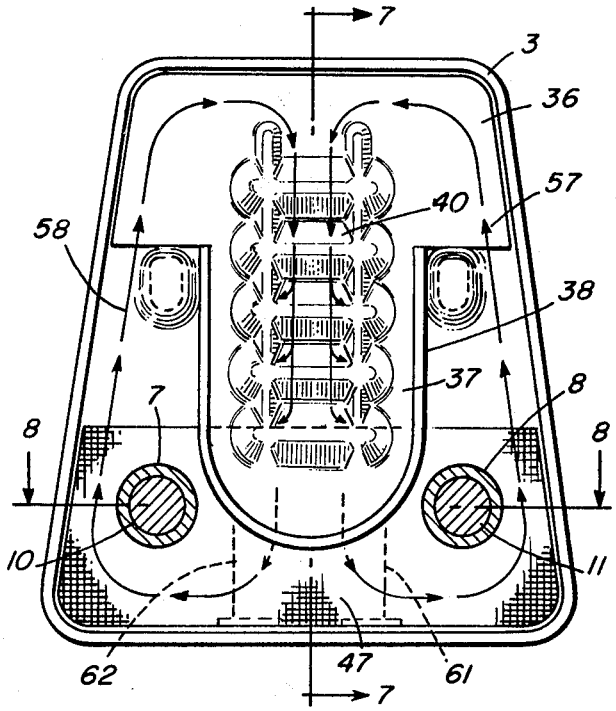

The muffler 1, thus assembled, defines a series of flow paths as follows:

(1) an inlet flow 53 of exhaust gas, shown in FIG. 7, passing from the engine exhaust 50 into muffler inlet 17;

(2) first and second, transversely separated or "split" flow paths 54 and 55, shown in FIG. 5, leading from inlet flow 53 to opening port area 34. Flow paths 54 and 55 are defined by the gaps between wall 15 and walls 27 and 28, respectively and are separated or "split" by connecting web 33;

(3) a recombined flow 56 of gas from flow paths 54 and 55, leading from port 34 along channel-like wall 33 to the screened outlet port 47, as shown in FIG. 7;

(4) third and fourth, transversely separated or "split" flow paths 57 and 58, shown in FIG. 6, separated by U-shaped rim 38 and leading from screened port 47 to a generally "T" shaped outlet passage 59 extending between "washboard" baffle 40 and the alternating, inclined louvers 22 and exhaust openings 23, as shown in FIG. 7; and (5) a once-again, recombined gas flow 60, shown in FIG. 7, passing through passage 59 and discharging to the atmosphere via openings 23.

With the structure of individual components having been described, and the mode of assembly of these components having been indicated, it is now appropriate to give specific consideration to the functional and method aspects attributable to the assembled muffler structure.

Functions and Methods of Sound Attenuation of Assembled Muffler

The first method aspect of the invention, as noted above, resides in a method for attenuating sound levels of exhaust gas issuing from engine exhaust systems. This method comprises the following functions involved in the operation of assembled muffler 1:

the transmitting of a flow 53 of engine exhaust gas into muffler means 1;

the splitting of the exhaust gas flow 53 into first and second, flow paths 54 and 55 within the muffler means;

the recombining of the exhaust gas from each of the first and second flow path 54 and 55 within the muffler means 1 by flowing gas from each of the first and second flow paths 54 and 55 generally toward and into each other in the area of port means 34 as mutually opposed gas flows to form a unified exhaust gas flow 56; and alternately compressing and expanding the exhaust gas flow 60 between "washboard" baffle 40 and louvers 22 as shown in FIG. 7 while concurrently permitting increments of the exhaust gas flow 60 to exit from the muffler means through openings 23, sequentially along the flow of the exhaust gas flow 60.

In the second method aspect of the invention, the first method aspect is supplemented by the progressive constricting of exhaust gas flow in each of the first and second flow paths 54 and 55, as shown in FIG. 5, with the exhaust gas in each of these first and second flow paths, during this progressive constricting, passing in heat dissapating relationship with heat transmitting external wall means 2 of the muffler means 1. The recombining of exhaust gas flow from each of the first and second flow paths 54 and 55 is effected with an abrupt constriction of the unified exhaust gas flow, due to the relatively restricted transverse cross sectional area of channel 33 and the concurrent causing of the unified exhaust gas flow to abruptly undergo a transversely directed change in flow direction, i.e. more downwardly into channel 33, as shown in FIG. 5. Alternately opposite, transverse changes in flow direction are caused to occur in the exhaust gas flow 60, concurrently with the alternate compressing and expansion of exhaust gas flow, due to the generally sinusoidal, or "zigzag" nature of passage 59.

The third method aspect of the invention, noted earlier, entails (following the recombining of exhaust gas flow from each of the first and second flow paths 54 and 55), the resplitting of the unified exhaust gas flow 56 into third and fourth flow paths 57 and 58 of generally equal length, with the first and second flow paths 54 and 55 also being of generally equal length. Exhaust gas flows from each of these third and fourth flow paths 57 and 58 are recombined by flowing gas from each of the third and fourth flow paths 54 and 55 toward and into each other in the area of head plate 36 above cavity 38 as generally mutually opposed gas flows to form a reunified exhaust gas flow 60.

The fourth method aspect of the invention entails a refinement of the third method aspect, wherein gas flowing through each of the first, second, third and fourth flow paths is progressively constricted, due to the tapered configuration of the muffler, and caused to pass in heat dissapating relation with heat transmitting external wall means 2 and 3 of the muffler means 1. In addition, the unified exhaust gas flow 56, obtained by recombining exhaust gas from each of the first and second flow paths 54 and 55, is abruptly constricted and caused to abruptly undergo a transversely directed change in flow direction, as noted above.

The fifth method aspect of the invention, noted at the outset of this disclosure, entails a refinement of the fourth method aspect wherein the exhaust gas flow 56 is caused to expand after the recombining of exhaust gas flowing from the first and second flow paths by entering the relatively large gas inlet mouths 61 and 62 which define the initiation of flow paths 57 and 58. In addition, as noted above, exhaust gas flow 60 is caused to undergo generally opposite, transverse changes in flow direction in conjunction with the alternate compressing and expansion of the reunified exhaust gas flow.

SUMMARY OF ADVANTAGES, UNOBVIOUSNESS, AND SCOPE OF INVENTION

The independently significant aspects of the invention, as noted earlier, are believed to provide a particularly effective, compact, noise attenuating concept, coupled with improved cooling of the exhaust gas flow. These advantages are particularly attractive in the context of two cycle engine operated chain saws.

The failure of the state-of-the-art, exemplified by prior patents noted at the outset of this disclosure, to anticipate or suggest the independently significant aspects of the invention, in and of itself, evidences the unobviousness of these concepts to long standing practitioners in the art.

Those familar with the present disclosure and skilled in the muffler art may well recognize additions, deletions, substitutions, modifications, reversal of parts, and other equivalent arrangements which would fall within the purview of the present invention, as defined by the appended claims.

What is claimed is:

1. A method of attenuating sound levels of exhaust gas issuing from engine exhaust systems, said method comprising:
- transmitting a flow of engine exhaust gas into muffler means;
- splitting said exhaust gas flow into first and second, flow paths within said muffler means;
- recombining exhaust gas from each of said first and second flow path within said muffler means by
  - flowing gas from each of said first and second flow paths generally toward and into each other as mutually opposed gas flows to form a unified exhaust gas flow; and
- alternately compressing and expanding said exhaust gas flow while concurrently
  - permitting increments of said exhaust gas flow to exit from said muffler means, sequentially along the flow of said exhaust gas flow(.);
- said alternate compression and expansion of said exhaust gas flow comprising
  - passing said exhaust gas flow generally transversely of the general direction of the exit flow direction of said exhaust gas,
  - sequentially and repeatedly restricting and expanding said flow of exhaust gas as said flow passes generally transversely of said general direction of exit flow, and
  - effecting sequential exiting of said exhaust gas at locations spaced along, and directed transversely of, said flow of exhaust gas effecting said alternate compression and expansion.

2. A method of attenuating sound levels of exhaust gas issuing from engine exhaust systems, said method comprising:
- transmitting a flow of engine exhaust gas into muffler means;
- splitting said exhaust gas flow into first and second, generally equal length, flow paths within said muffler means, and
  - progressively constricting the flow of exhaust gas in each of said first and second flow paths, and
  - during said progressive constricting, passing the exhaust gas in each of first and second flow paths in heat dissipating relation with heat transmitting, external wall means of said muffler means;
- recombining exhaust gas from each of said first and second flow path within said muffler means by
  - flowing gas from each of said first and second flow paths generally toward and into each other as mutually opposed gas flows to form a unified exhaust gas flow, and
  - abruptly constricting said unified exhaust gas flow and concurrently causing said unified exhaust gas flow to abruptly undergo a transversely directed change in flow direction; and
- alternately compressing and expanding said exhaust gas flow while concurrently
  - permitting increments of said exhaust gas flow to exit from said muffler means, sequentially along the flow of said exhaust gas flow, and
  - inducing generally alternately opposite, transverse changes in flow direction of said exhaust gas flow.

3. A method of attenuating sound levels of exhaust gas issuing from engine exhaust systems, said method comprising:
- transmitting a flow of engine exhaust gas into muffler means;
- splitting said exhaust gas flow into first and second, generally equal length, flow paths within said muffler means;
- recombining exhaust gas from each of said first and second flow path within said muffler means by
  - flowing gas from each of said first and second flow paths generally toward and into each other as mutually opposed gas flows to form a unified exhaust gas flow;
- resplitting said unified gas flow into generally equal length, third and fourth flow paths within said muffler means;
- recombining exhaust gas from each of said third and fourth flow paths within said muffler means by
  - flowing gas from each of said third and fourth flow paths toward and into each other as mutually opposed gas flows to form a rectified exhaust gas flow; and
- alternately compressing and expanding said reunified exhaust gas flow while concurrently
  - permitting increments of said reunified exhaust gas flow to exit from said muffler means, sequentially along the flow of said reunified exhaust gas flow;
- said alternate compression and expansion of said exhaust gas flow comprising
  - passing said exhaust gas flow generally transversely of the general direction of the exit flow direction of said exhaust gas,
  - sequentially and repeatedly restricting and expanding said flow of exhaust gas as said flow passes generally transversely of said general direction of exit flow, and
  - effecting sequential exiting of said exhaust gas at locations spaced along, and directed transversely of, said flow of exhaust gas effecting said alternate compression and expansion.

4. A method of attenuating sound levels of exhaust gas issuing from engine exhaust systems, said method comprising:
- transmitting a flow of engine exhaust gas into muffler means;
- splitting said exhaust gas flow into first and second, generally equal length, flow paths within said muffler means, and progressively constricting the flow of exhaust gas in each of said first and second flow paths, and during said progressive constricting, passing the exhaust gas in each of first and second flow paths in heat dissipating relation with heat transmitting, external wall means of said muffler means;

recombining exhaust gas from each of said first and second flow path within said muffler means by flowing gas from each of said first and second flow paths generally toward and into each other as mutually opposed gas flows to form a unified exhaust gas flow, and abruptly constricting said unified exhaust gas flow and concurrently causing said unified exhaust gas flow to abruptly undergo a transversely directed change in flow direction;

resplitting said unified exhaust gas flow into generally equal length, third and fourth flow paths within said muffler means and progressively constricting the flow of exhaust gas in each of said third and fourth flow paths, and during said progressive constricting, passing the exhaust gas in each of said third and fourth flow paths in heat dissipating relation with heat transmitting, external wall means of said muffler means;

recombining exhaust gas from each of said third and fourth flow paths within said muffler means by flowing gas from each of said third and fourth flow paths toward and into each other as mutually opposed gas flows to form a reunified exhaust gas flow; and alternately compressing and expanding said reunified exhaust gas flow while concurrently permitting increments of said reunified exhaust gas flow to exit from said muffler means, sequentially along the flow of said reunified exhaust gas flow.

5. A method of attenuating sound levels of exhaust gas issuing from engine exhaust systems, said method comprising:

transmitting a flow of engine exhaust gas into muffler means;

splitting said exhaust gas flow into first and second, generally equal length, flow paths within said muffler means, and progressively constricting the flow of exhaust gas in each of said first and second flow paths, and during said progressive constricting, passing the exhaust gas in each of first and second flow paths in heat dissipating relation with heat transmitting, external wall means of said muffler means;

recombining exhaust gas from each of said first and second flow path within said muffler means by flowing gas from each of said first and second flow paths generally toward and into each other as mutually opposed gas flows to form a unified exhaust gas flow, and abruptly constricting said unified exhaust gas flow and concurrently causing said unified exhaust gas flow to abruptly undergo a transversely directed change in flow direction;

expanding said unified exhaust gase flow within said muffler means;

resplitting said unified exhaust gas flow into generally equal length, third and fourth flow paths within said muffler means and progressively constricting the flow of exhaust gas in each of said third and fourth flow paths, and during said progressive constricting, passing the exhaust gas in each of said third and fourth flow paths in heat dissipating relation with heat transmitting, external wall means of said muffler means;

recombining exhaust gas from each of said third and fourth flow paths within said muffler means by flowing gas from each of said third and fourth flow paths toward and into each other as mutually opposed gas flows to form a reunified exhaust gas flow; and alternately compressing and expanding said reunified exhaust gas flow while concurrently permitting increments of said reunified exhaust gas flow to exit from said muffler means, sequentially along the flow of said reunified exhaust gas flow, and inducing generally alternately opposite, transverse changes in flow direction of said reunified exhaust gas flow.

6. Apparatus for attenuating sound levels of exhaust gas issuing from engine exhaust systems, said apparatus comprising muffler means including:

means for receiving a flow of engine exhaust gas;

means for splitting said exhaust gas flow into first and second flow paths within said muffler means;

means for recombining exhaust gas from each of said first and second flow path within said muffler means by flowing gas from each of said first and second flow paths generally toward and into each other as mutually opposed gas flows to form a unified exhaust gas flow;

means for alternately compressing and expanding said exhaust gas flow while concurrently permitting increments of said exhaust gas flow to exit from said muffler means, sequentially along the flow of said exhaust gas flow;

said means for alternately compressing on and expanding said exhaust gas flow comprising means for passing said exhaust gas flow generally transversely of the general direction of the exit flow direction of said exhaust gas, means for sequentially and repeatedly restricting and expanding said flow of exhaust gas as said flow passes generally transversely of said general direction of exit flow, and means for effecting sequential exiting of said exhaust gas at locations spaced along, and directed transversely of, said flow of exhaust gas affecting said alternate compression and expansion.

7. Apparatus for attenuating sound levels of exhaust gas issuing from engine exhaust systems, said apparatus comprising muffler means having heat transmitting, external wall means and including:

means for receiving a flow of engine exhaust gas;

means for splitting said exhaust gas flow into first and second, generally equal length, flow paths within said muffler means, and progressively constricting the flow of exhaust gas in each of said first and second flow paths, and during said progressive constricting, passing the exhaust gas in each of first and second flow paths in heat dissipating relation with said heat transmitting, external wall means of said muffler means;

means for recombining exhaust gas from each of said first and second flow paths within said muffler means by flowing gas from each of said first and second flow paths generally toward and into each other as mutually opposed gas flows to form a unified exhaust gas flow, and abruptly constricting said unified exhaust gas flow and concurrently causing said unified exhaust gas flow to abruptly undergo a transversely directed change in flow direction; and means for alternately compressing and expanding said exhaust gas flow while concurrently permitting increments of said exhaust gas flow to exit from said muffler means, sequentially along the flow of said exhaust gas flow, and inducing generally alternately opposite, transverse changes in flow direction of said exhaust gas flow.

8. Apparatus for attenuating sound levels of exhaust gas issuing from engine exhaust systems, said apparatus comprising muffler means including:

means for receiving a flow of engine exhaust gas;

means for splitting said exhaust gas flow into first and second, generally equal length, flow paths within said muffler means;

means for recombining exhaust gas from each of said first and second flow paths within said muffler means by flowing gas from each of said first and second flow paths generally toward and into each other as mutually opposed gas flows to form a unified exhaust gas flow;

means for resplitting said unified exhaust gas flow into generally equal length, third and fourth flow paths within said muffler means;

means for recombining exhaust gas from each of said third and fourth flow paths within said muffler means by flowing gas from each of said third and fourth flow paths toward and into each other as mutually opposed gas flows to form a reunified exhaust gas flow; and means for alternately compressing and expanding said reunified exhaust gas flow while concurrently permitting increments of said reunified exhaust gas flow to exit from said muffler means, sequentially along the flow of said reunified exhaust gas flow;

said means for alternately compressing on and expanding said exhaust gas flow comprising means for passing said exhaust gas flow generally transversely of the general direction of the exit flow direction of said exhaust gas, means for sequentially and repeatedly restricting and expanding said flow of exhaust gas as said flow passes generally transversely of said general direction of exit flow, and means for effecting sequential exiting of said exhaust gas at locations spaced along, and directed transversely of, said flow of exhaust gas effecting said alternate compression and expansion.

9. Apparatus for attenuating sound levels of exhaust gas issuing from engine exhaust systems, said apparatus comprising muffler means having heat transmitting, external wall means and including:

means for receiving a flow of engine exhaust gas;

means for splitting said exhaust gas flow into first and second, generally equal length, flow paths within said muffler means, and progressively constricting the flow of exhaust gas in each of said first and second flow paths, and during said progressive constricting, passing the exhaust gas in each of first and second flow paths in heat dissipating relation with said heat transmitting, external wall means of said muffler means;

means for recombining gas from each of said first and second flow path within said muffler means by flowing gas from each of said first and second flow paths generally toward and into each other as mutually opposed gas flows to form a unified exhaust gas flow, and abruptly constricting said unified exhaust gas flow and concurrently causing said unified exhaust gas flow to abruptly undergo a transversely directed change in flow direction;

means for resplitting said unified exhaust gas flow into generally equal length, third and fourth flow paths within said muffler means and progressively constricting the flow of exhaust gas in each of said third and fourth flow paths, and during said progressive constricting, passing the exhaust gas in each of said third and fourth flow paths in heat dissipating relation with said heat transmitting, external wall means of said muffler means;

means for recombining exhaust gas from each of said third and fourth flow paths within said muffler means by flowing gas from each of said third and fourth flow paths toward and into each other as mutually opposed gas flows to form a reunified exhaust gas flow; and means for alternately compressing and expanding said reunified exhaust gas flow while concurrently permitting increments of said reunified exhaust gas flow to exit from said muffler means, sequentially along the flow of said reunified exhaust gas flow.

10. Apparatus for attenuating sound levels of exhaust gas issuing from engine exhaust systems, said apparatus comprising muffler means having heat transmitting, external wall means and including:

means for receiving a flow of engine exhaust gas;

means for splitting said exhaust gas flow into first and second, generally equal length, flow paths within said muffler means, and progressively constricting the flow of exhaust gas in each of said first and second flow paths, and during said progressive constricting, passing the exhaust gas in each of first and second flow paths in heat dissipating relation with said heat transmitting, external wall means of said muffler means;

means for recombining exhaust gas from each of said first and second flow path within said muffler means by flowing gas from each of said first and second flow paths generally toward and into each other as mutually opposed gas flows to form a unified exhaust gas flow, and abruptly constricting said unified exhaust gas flow and concurrently causing said unified exhaust gas flow to abruptly undergo a transversely directed change in flow direction;

means for expanding said unified exhaust gase flow within said muffler means;

means for resplitting said unified exhaust gas flow into generally equal length, third and fourth flow paths within said muffler means and progressively constricting the flow of exhaust gas in each of said third and fourth flow paths, and during said progressive constricting, passing the exhaust gas in each of said third and fourth flow paths in heat dissipating relation with said heat transmitting, external wall means of said muffler means;

means for recombining exhaust gas from each of said third and fourth flow paths within said muffler means by flowing gas from each of said third and fourth flow paths toward and into each other as mutually opposed gas flows to form a reunified exhaust gas flow; and means for alternately compressing and expanding said reunified exhaust gas flow while concurrently permitting increments of said reunified exhaust gas flow to exit from said muffler means, sequentially along the flow of said reunified exhaust gas flow, and inducing generally alternately opposite, transverse changes in flow direction of said reunified exhaust gas flow.

* * * * *